US009636596B2

(12) United States Patent
Baltus et al.

(10) Patent No.: US 9,636,596 B2
(45) Date of Patent: May 2, 2017

(54) DYNAMIC BALLOON DISPLAY DEVICE AND METHOD FOR USE THEREOF

(71) Applicants: Gregory D. Baltus, Pittsburgh, PA (US); Nathan Michael Martin, Pittsburgh, PA (US); Matthew A. Pegula, Pittsburgh, PA (US); Michael B. Schwerin, Pittsburgh, PA (US); Justin C. Lacey, Pittsburgh, PA (US); Patrick Miller, Pittsburgh, PA (US); Zachary G. Olshenske, North Huntingdon, PA (US)

(72) Inventors: Gregory D. Baltus, Pittsburgh, PA (US); Nathan Michael Martin, Pittsburgh, PA (US); Matthew A. Pegula, Pittsburgh, PA (US); Michael B. Schwerin, Pittsburgh, PA (US); Justin C. Lacey, Pittsburgh, PA (US); Patrick Miller, Pittsburgh, PA (US); Zachary G. Olshenske, North Huntingdon, PA (US)

(73) Assignee: Deeplocal, Inc., Pittsburgh, PA (US)

( * ) Notice: Subject to any disclaimer, the term of this patent is extended or adjusted under 35 U.S.C. 154(b) by 0 days.

(21) Appl. No.: 14/808,591

(22) Filed: Jul. 24, 2015

(65) Prior Publication Data

US 2016/0104432 A1 Apr. 14, 2016

Related U.S. Application Data

(60) Provisional application No. 62/063,182, filed on Oct. 13, 2014.

(51) Int. Cl.

| | |
|---|---|
| ***A63H 27/10*** | (2006.01) |
| ***G09F 21/06*** | (2006.01) |
| ***G09F 27/00*** | (2006.01) |

(52) U.S. Cl.
CPC ..... *A63H 27/10* (2013.01); *G09F 21/06* (2013.01); *G09F 27/00* (2013.01); *A63H 2027/1033* (2013.01)

(58) Field of Classification Search
CPC ..... G06F 3/016; F15B 15/103
(Continued)

(56) References Cited

U.S. PATENT DOCUMENTS

| | | |
|---|---|---|
| 1,642,022 A | 3/1925 | Groh |
| 4,892,500 A | 1/1990 | Lau |

(Continued)

OTHER PUBLICATIONS

Orf, Darren,. How It Works: MIT's inFORM Dynamic Shape Display, published Dec. 2, 2013. Retrieved from internet, URL: http://www.popularmechanics.com/technology/design/a9847/how-mits-inform-dynamic-display-works-16222829/.*

*Primary Examiner* — Thomas Lett
(74) *Attorney, Agent, or Firm* — Tucker Arensberg, P.C.

(57) ABSTRACT

A balloon display device configured to create displays representative of digital images. The device may comprise a processor configured to transmit instructions for creating the display to a display panel, which comprises one or more balloon boxes. Each balloon box may comprise at least one balloon coupled to a pneumatic control. An electronic control can be configured to receive instructions for turning on or off specified valves to inflate or deflate the balloon. An associated method may comprise converting a digital image into readable instructions for creating a balloon display. The instructions, which may comprise commands for inflating or deflating a balloon, may then be transmitted to the display device and executed to create the display.

18 Claims, 6 Drawing Sheets

(58) Field of Classification Search
USPC ..... 345/473
See application file for complete search history.

(56) References Cited

U.S. PATENT DOCUMENTS

| | | | | |
|---|---|---|---|---|
| 5,127,867 | A | 7/1992 | Lau | |
| 5,282,768 | A | 2/1994 | Akman | |
| 5,464,354 | A | 11/1995 | Akman | |
| 5,533,285 | A * | 7/1996 | Skistimas | A63H 27/10 211/89.01 |
| 5,675,922 | A | 10/1997 | Skistimas | |
| 6,332,823 | B1 * | 12/2001 | Rouse, Jr. | A63H 27/10 446/220 |
| 6,478,057 | B1 | 11/2002 | Bearss | |
| 6,903,871 | B2 * | 6/2005 | Page | B29C 33/307 359/277 |
| 7,094,124 | B1 * | 8/2006 | Rouse | G09F 23/00 40/212 |
| 7,491,109 | B2 | 2/2009 | Rouse | |
| 7,507,137 | B1 * | 3/2009 | Rouse | A63H 27/10 428/12 |
| 8,789,565 | B1 | 7/2014 | Wicken | |
| 2008/0121309 | A1 | 5/2008 | Boise | |
| 2009/0040224 | A1 | 2/2009 | Igarashi | |
| 2009/0133299 | A1 | 5/2009 | Blackwell | |
| 2010/0147994 | A1 * | 6/2010 | Nguyen | F21V 3/023 244/31 |
| 2012/0293411 | A1 * | 11/2012 | Leithinger | G06F 3/017 345/158 |
| 2014/0038490 | A1 | 2/2014 | Smith | |
| 2014/0314976 | A1 * | 10/2014 | Niiyama | F15B 15/103 428/34.3 |

* cited by examiner

DYNAMIC BALLOON DISPLAY DEVICE AND METHOD FOR USE THEREOF

BACKGROUND

The present disclosure provides for a balloon display device for creating both static displays and animations. The device overcomes the limitations of the prior art by providing a novel pneumatic valve and manifold assembly. These features provide for controlled and consistent inflation and rapid deflation of balloons, enabling the device to quickly create many different displays. For example, the pneumatic controls of the device may be configured to create multiple displays per minute.

The device further overcomes the limitations of the prior art by providing a modular structure, simplifying fabrication, assembly, and installation of the device. By implementing modular IP-based control systems, the device could, in theory, control an unlimited number of balloons.

SUMMARY

In one embodiment, the present disclosure provides for a device for creating one or more balloon displays representative of a digital image and/or video (collectively referred to herein as a digital image). The device may comprise at least one processor and a balloon display panel comprising a plurality of balloon boxes. Each balloon box may comprise at least one of: a balloon, a pneumatic control comprising at least one valve, and an electronic control. The processor may generate instructions for creating the display and transmit these instructions to the appropriate balloon box. The electronic control may receive the instructions and cause the pneumatic control to execute them. These instructions may comprise one or more commands for turning specified valves on or off, resulting in the inflation, deflation, or maintaining the inflation of the corresponding balloons. The present disclosure contemplates the electronic control may operate in either an open loop or a closed loop control algorithm. Open loop configurations may be preferable for creating static displays whereas closed loop configurations may be preferable for creating animated displays.

In another embodiment, the present disclosure provides for a method for creating balloon displays representative of digital images. A digital image may be converted into readable instructions for creating at least one display. The instructions may include commands for turning on or off specified valves of a display device which result in inflating, deflating, or maintaining the inflation of the corresponding balloons. The instructions may be transmitted to the display device and executed to create the display.

In yet another embodiment, the present disclosure provides for a system comprising a processor and a non-transitory processor-readable storage medium in operable communication with the processor. The storage medium may contain or more programming instructions that cause the processor to convert a digital image into readable instructions for creating at least one display. The instructions may include commands for turning on or off specified valves which result in inflating, deflating, or maintaining the inflation of the corresponding balloons. The programming instructions may further cause the processor to transmit the instructions to the display device and execute the instructions to create the display.

BRIEF DESCRIPTION OF THE DRAWINGS

The accompanying drawings, which are included to provide further understanding of the disclosure and are incorporated in and constitute a part of this specification illustrate embodiments of the disclosure, and together with the description, serve to explain the principles of the disclosure.

In the drawings.

DETAILED DESCRIPTION

Reference will now be made in detail to the embodiments of the present disclosure, examples of which are illustrated in the accompanying drawings. Wherever possible, the same reference numbers will be used throughout the specification to refer to the same or like parts.

Figure 1:
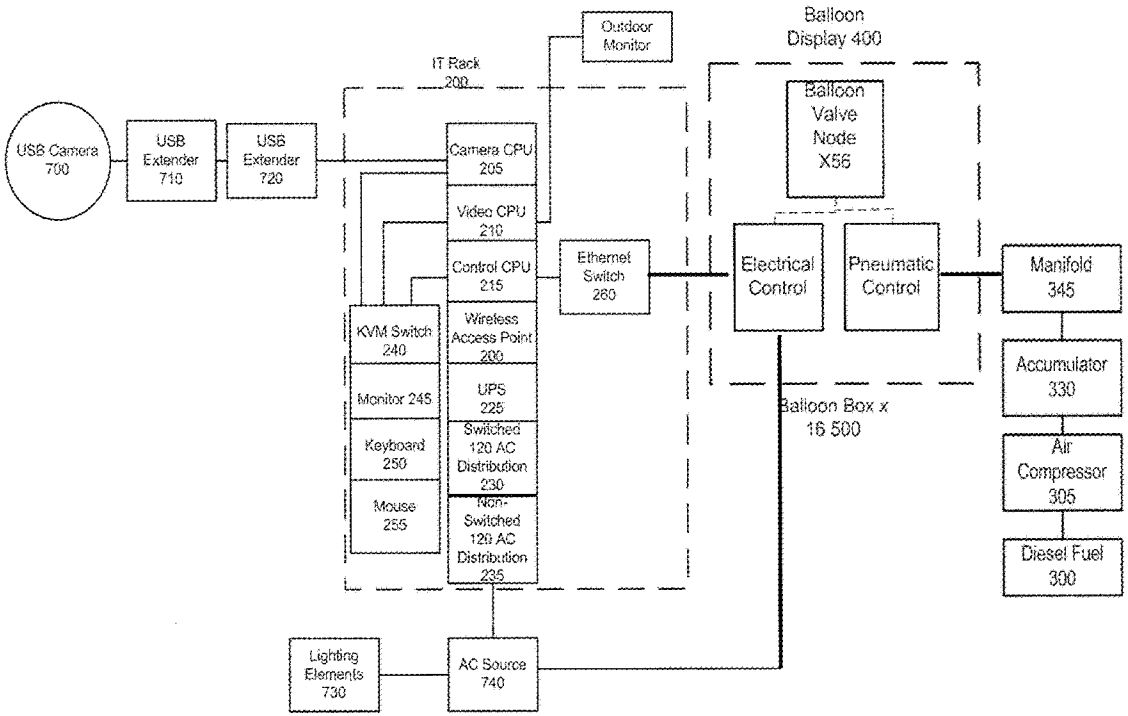
FIG. 1 is illustrative of a device of the present disclosure.

FIG. 1 illustrates one embodiment of the present disclosure. The device 100 may comprise at least a processor (IT rack 200) operably coupled to a balloon display panel 400. The IT rack 200 may be configured for controlling, operating, and troubleshooting the entire device 100 or individual components thereof. For example the IT rack 200 may comprise one or more central processing units (CPUs) such as a camera CPU 205, a video CPU 210, and a control CPU 215. The IT rack 200 may further comprise a wireless access point 220, a UPS 225, a switched AC distribution 230, and a non-switched distribution 235. To enable user operation, a KVM switch 240, a monitor 245, a keyboard 250, and a mouse 255 may also be included in the IT rack. The present disclosure contemplates flexibility in the processor configurations. For example, each balloon box 500 may be assigned a dedicated processor. Or, one processor may be used to operate the entire device 100.

The processor may also be configured to convert a digital image into readable instructions for creating a balloon display and transmit these instructions to the device for execution. The present disclosure contemplates interaction with third party users via the internet and online social medial platforms. In such an embodiment, the processor may capture images or video posted by a user and generate instructions for creating displays based on them.

In one embodiment, balloons may be inflated or deflated based on timing commands included in the instructions. For example, a set of instructions may contain a command to turn on a valve associated with a specific balloon for a specified period of time, inflating the balloon to a desired diameter. Therefore, it is important that consistent pressure be delivered to each balloon of the device 100. To provide this consistent pressure, the device 100 may comprise a plurality of manifolds (for example see 345, 525, and 330 of FIG. 1 and FIG. 2) and assemblies, in a step-down configuration. This means that with each manifold, the compressed air is further distributed to various parts of the device.

Figure 2A:
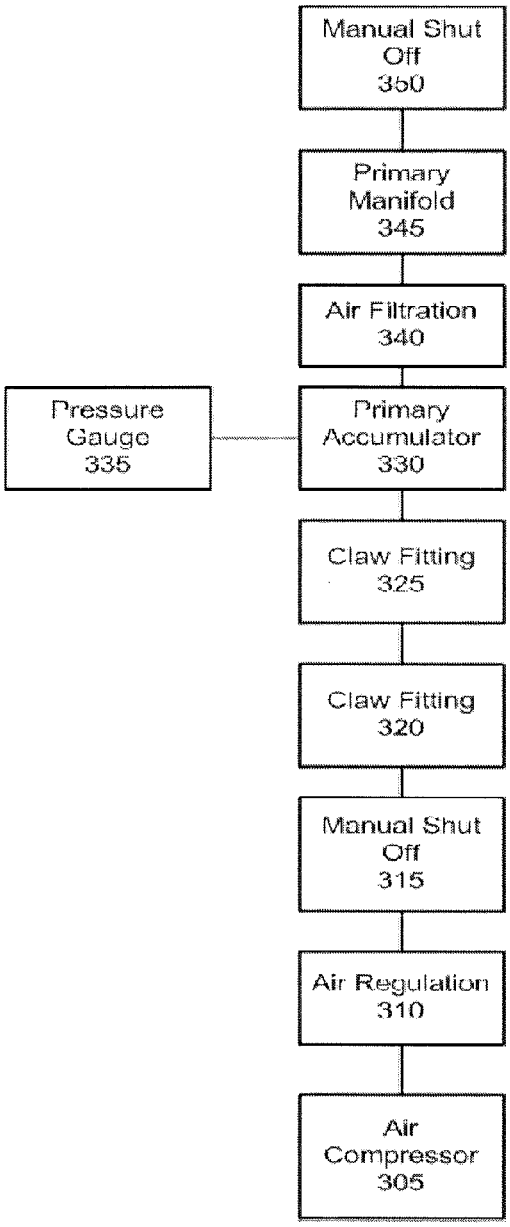
FIG. 2A is illustrative of a device of the present disclosure.
Figure 2B:
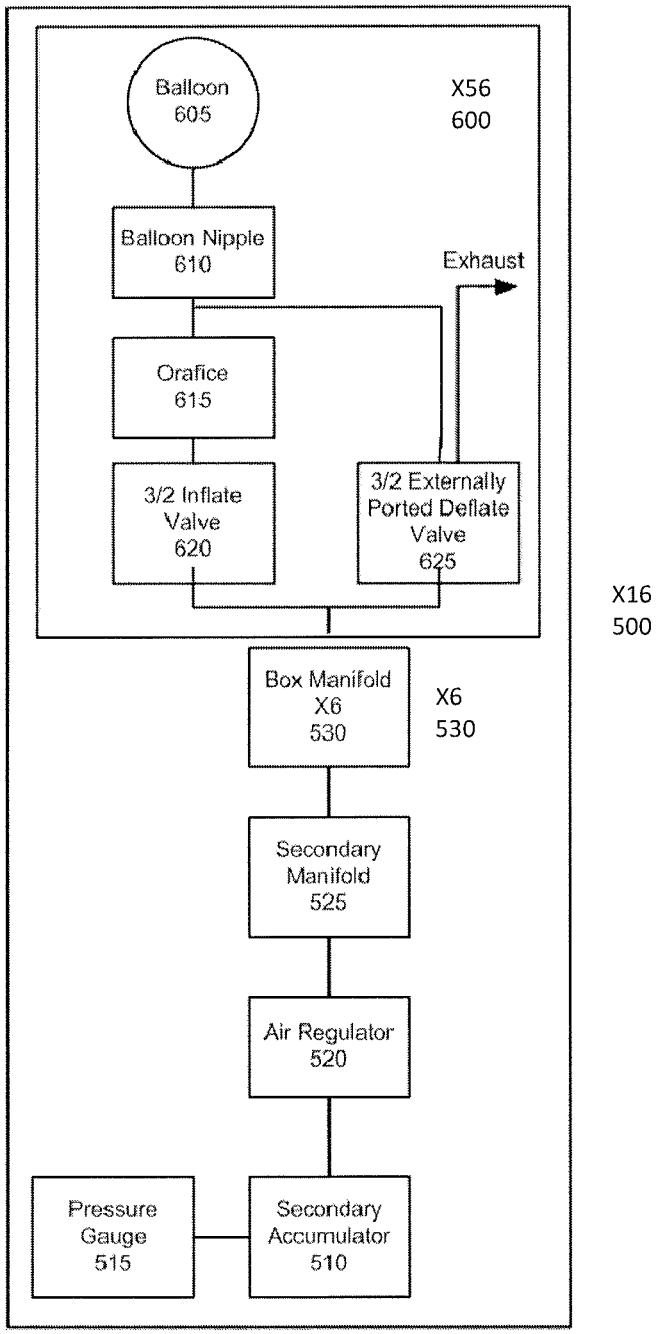
FIG. 2B is illustrative of a device of the present disclosure.

FIG. 2A and FIG. 2B illustrate various pneumatic controls of the device 100. Referring to FIG. 2A, a first plurality of components 301 may comprise an air compressor 305 configured to deliver compressed gas to the device 100. While the present disclosure contemplates the use of atmospheric air, any compressed gas may be used (for example nitrogen). Use of the air compressor 305 enables the device 100 to operate for a prolonged period of time. While it may be possible to operate the device 100 without the use of an air compressor 305, such alternative embodiments may affect its operating time. For example, the present discourse contemplates the device 100 could also be operated using an air blower.

The air compressor 305 may be coupled via one or more fittings 320 and 325 to a primary receiver 330 configured to store the compressed gas. An air regulator 310 and a manual shut off mechanism 315, which are illustrated in more detail in FIG. 2, may also be used to provide further control of the compressed gas. The primary receiver 330 may be coupled to a primary manifold 345 configured to enable distribution and delivery of the stored compressed gas to the rest of the device 100.

An air filtration mechanism 340 known in the art may also be inserted between the primary receiver 330 and the primary manifold 345. To further control the distribution and delivery of compressed gas to different parts of the device 100, an additional manual shut off mechanism 350 may be inserted between the primary manifold 345 and the balloon display panel 400. This first plurality of components 301 may be operably coupled to a second plurality of components described in more detail in FIG. 2B.

The balloon display panel 400 may comprise one or more balloon boxes 500, where each balloon box 500 further comprises additional pneumatic controls and one or more balloon nodes 600. In one embodiment, the balloon boxes 500 may further comprise electric controls (including a microprocessor and a network switch). In another embodiment, the present disclosure also contemplates that instead of running an electric signal to the balloon box 500, a pneumatic signal can be used.

In a modular design, each balloon box 500 may be self-supporting or affixed to a common support (the display panel 400). It is contemplated that each balloon box 500 may have its own power source. It is also contemplated that a single power source 740, or multiple power sources, could be used to operate the entire device 100.

The number and arrangement of balloon boxes and balloon nodes may be adjusted depending on the desired size and specificity of the display. A modular configuration provides for flexibility in the design, enabling additional balloon boxes to be added or removed, changing the size and scale of the display. In addition, each balloon box may be individually tested, repaired, or replaced as needed, without affecting the overall device. However, the present disclosure is not limited to a modular design and it is contemplated that in other embodiments the device may be configured as one self-supporting unit.

Details of the additional pneumatic controls and balloon nodes 600 are further illustrated in FIG. 2B. A secondary receiver 510 may be configured to store compressed gas within each balloon box 500 for distribution to the balloons. A pressure gauge 515 may be used to monitor the pressure of the gas in the second receiver 510, but it is not necessary. Compressed gas may flow from the secondary receiver to a secondary manifold 525, via an air regulator 520, and further to one or more box manifolds 530. Each box manifold 530 may be operably coupled to one or more balloon nodes 600 so as to deliver compressed gas to each balloon 605.

Within each balloon node 600 are various components that enable the inflation or deflation of each associated balloon 605. Each balloon node 600 may comprise at least one balloon 605 coupled to at least one pneumatic control. In FIG. 2, the balloon nipple 610 is coupled to one or more valves including an inflate valve 620, configured to pass a compressed gas into the balloon, and a deflate valve 625 configured to allow a compressed gas to escape the balloon. Instructions received by a microprocessor through an electronic control circuit may cause these valves to turn on or off. The balloon 605 may vent air (deflate) passively by using the pressure of the balloon 605 itself. However, the present disclosure is not limited to passive deflation and it is contemplated that a mechanism, such as a vacuum or air blower could be added to the device 100 to enable active deflation of the balloon 605.

The present disclosure contemplates embodiments in which the valves 620 and 625 may comprise piloted and/or non-piloted valves. In one embodiment, one or more valves 620 and 625 may further comprise an externally piloted three-way valve. Such an embodiment is advantageous over the prior art because it provides for more control over the inflation/deflation of the balloons.

The balloon node 600 may further comprise at least one orifice 615 located in front of the inflate valve 620 through which compressed gas may pass into the balloon 605. This orifice 615 holds potential for controlling the flow of gas into the balloon 605 so that it is consistent. The position of the orifice 615 was chosen to reduce noise during operation of the device 100. While the present disclosure contemplates that the orifice 615 may be located at the back of the inflate valve 620, this would greatly increase noise during operation of the device 100.

In an alternative embodiment, each balloon node 600 (or each balloon box 500) may comprise one or more sensors configured to monitor one or more associated balloons 605. In such an embodiment, rather than relying on instructions containing timing commands, each balloon 605 may be monitored during inflation and deflation. The sensors may be coupled to one or more valves 620 and 625. For example, to create an animation, the display 100 may couple the sensor to a microcontroller, which may implement a PID control loop algorithm to consistently adjust and control the rate of inflation and deflation of the balloons. In one embodiment, the sensor may comprise a camera. The PID may continually update, which in combination with additional software, may enable the continuous inflation and deflation of balloons. In other embodiments, the device 100 may further comprise one or more cameras 700 to generate digital images and/or video of balloon displays created. The camera 700 may be coupled to the IT rack 200 via USB extenders 710 and 720. Lighting elements 730 may also be used to aid in generating images and/or video of the displays.

Figure 3:
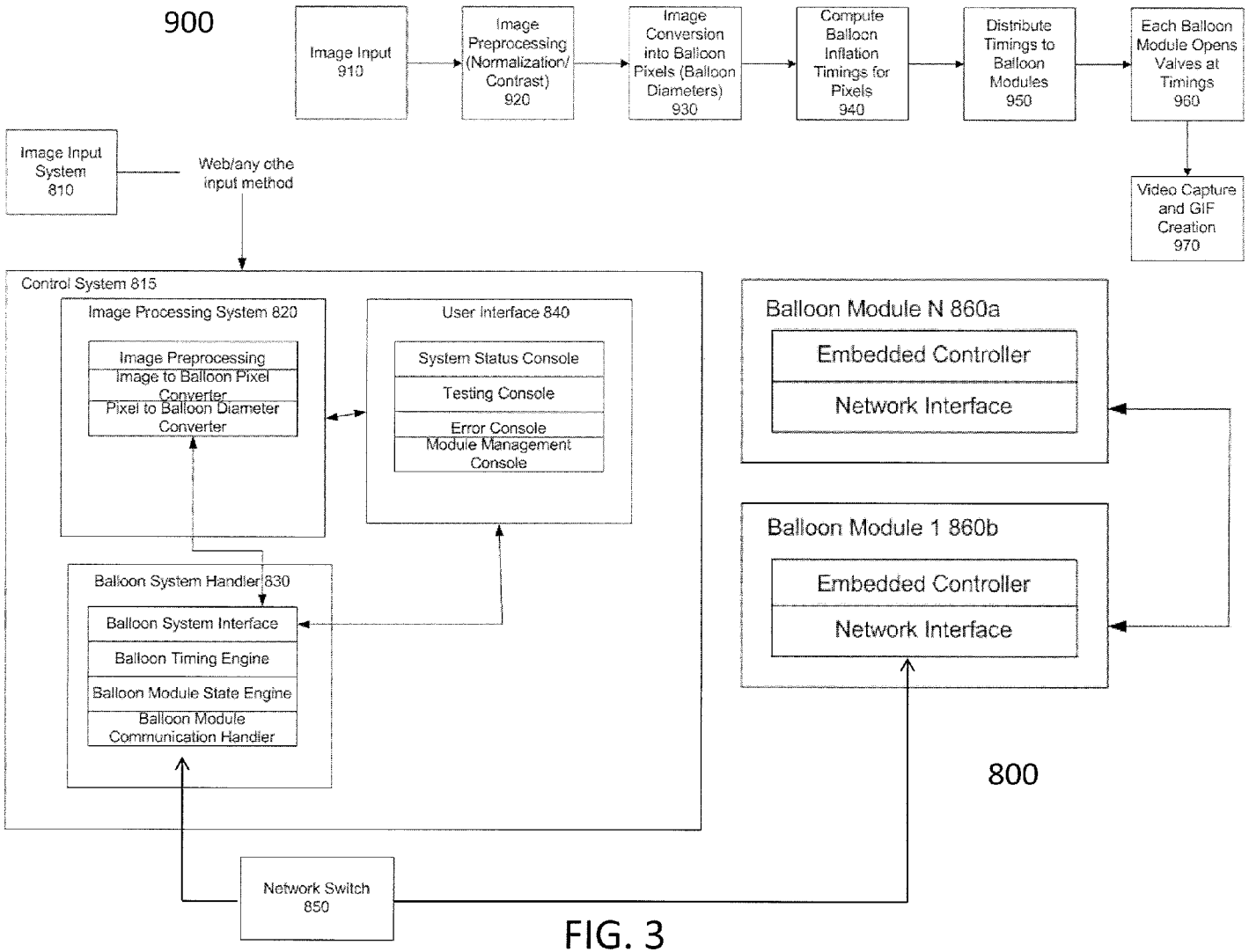
FIG. 3 is illustrative of a device of the present disclosure.

FIG. 3 is illustrative of software components of one embodiment of the device 100, showing both system components 800 and method components 900. The software system 800 may comprise an image input system 810 coupled to a software control system 815. The software control system 815 may comprise at least one of an image processing system 820, a balloon system handler 830, and a user interface 840. These subsystems may cooperate with the various balloon boxes 860*a* and 860*b*.

The image processing system 820 may be configured so as to perform image preprocessing, convert pixels to balloons, and calculate the corresponding balloon diameter based on the pixel intensity. The balloon system handler 830 may interface with the user interface 840 and also be configured to control timing components and communicate with the balloon boxes 860*a* and 860*b* via a network switch 850. The user interface 840 may be configured with a plurality of consoles to enable a user to monitor and operate the device 100. In one embodiment, the user interface 840 may comprise at least one of: a system status console, a testing console, an error console, and a module management console.

Figure 4:
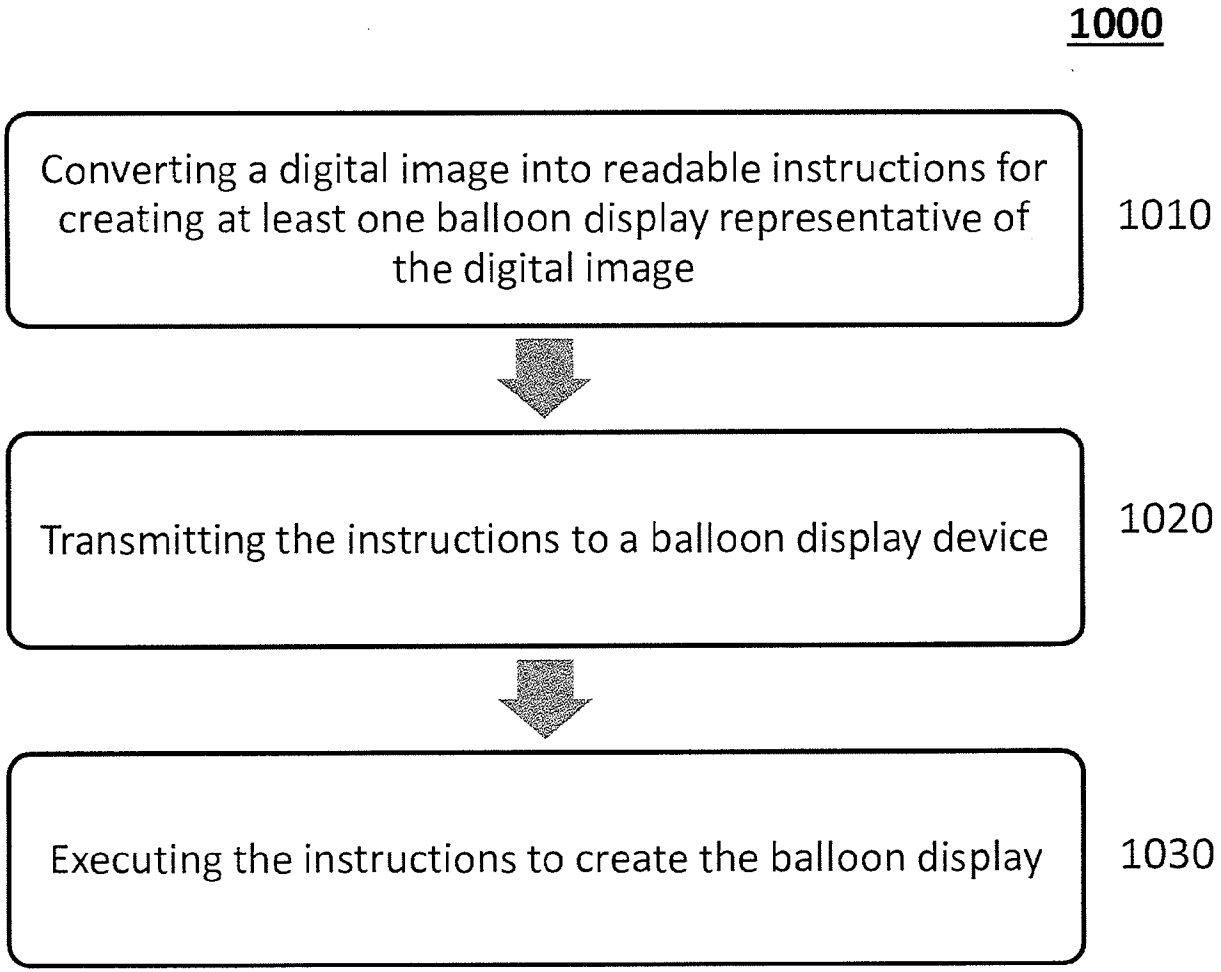
FIG. 4 is illustrative of a method of the present disclosure.

The present disclosure also provides for a method for creating at least one balloon display representative of a digital image. These methods are illustrated in FIG. 3 and FIG. 4. Referring to FIG. 3, the method 900 may comprise imputing an image in step 910. The image may be preprocessed in step 920. In step 930, the image may be converted to pixels and a balloon diameter calculated for each pixel. In one embodiment this diameter may be dependent on the intensity of the pixel. In step 940, balloon timings necessary to achieve each calculated diameter may be determined and these timings may be distributed to the corresponding balloons in step 950. The valves of the corresponding balloon may be opened in step 960 to inflate the balloons to the desired diameter. A video may be captured of the balloon display and converted into a GIF in step 970. The present disclosure contemplates this GIF may be transmitted to the user who generated the original image.

In another embodiment, the present disclosure also provides for a method for creating one or more balloon displays representative of a digital image. In one embodiment, illustrated by FIG. 4, a method 1000 comprises converting a digital image into readable instructions for creating at least one display in step 1010. The present disclosure contemplates that these images may be generated by third party users and posted or transmitted via the internet including online social media platforms. In such an embodiment, the method 1000 may further comprise accessing and evaluating these images. For example, a moderator may review images to ensure the content is suitable for display. Images that are not suitable may be rejected.

The instructions may comprise a plurality of commands for turning on or off specified valves which results in the inflating, deflating, or maintaining the inflation of corresponding balloons. These instructions may include timing commands such as turning on or off specific valves for specified periods of time. These timing commands will cause the balloons to inflate to various diameters.

In one embodiment, the desired diameter of each balloon is determined by assessing the intensity of each pixel in the digital image. One or more algorithms may be applied to assign the desired diameter of each balloon depending on the intensity of the corresponding pixel location in the image (for example the darker the pixel, the larger the diameter, or vice versa). One or more algorithms may then be applied to generate the timing commands necessary for the valves associated with each balloon to enable inflation, deflation, or maintain the inflation of each balloon to the desired diameter. In one embodiment, the applied algorithms may account for specific characteristics of the type of balloon used. These characteristics may include the balloon's material, internal pressure when inflated, inflation curve, and how the balloon responds to changes in environmental conditions such as temperature. These commands may be packaged in a set of instructions specific for balloons located in one or more locations on the display and transmitted to the device in step 1020. In step 1030, the instructions may be executed by the components of the device to create a balloon display representative of the digital image.

In one embodiment, the method 1000 may further comprise first applying one or more pre-processing techniques known in the art to the digital image. Preprocessing techniques may be used to enhance features of the image such as contrast and to convert a color image to black and white or grayscale. The image may be converted into a specified number of pixels, wherein each pixel corresponds to at least one balloon of the device.

Figure 5:
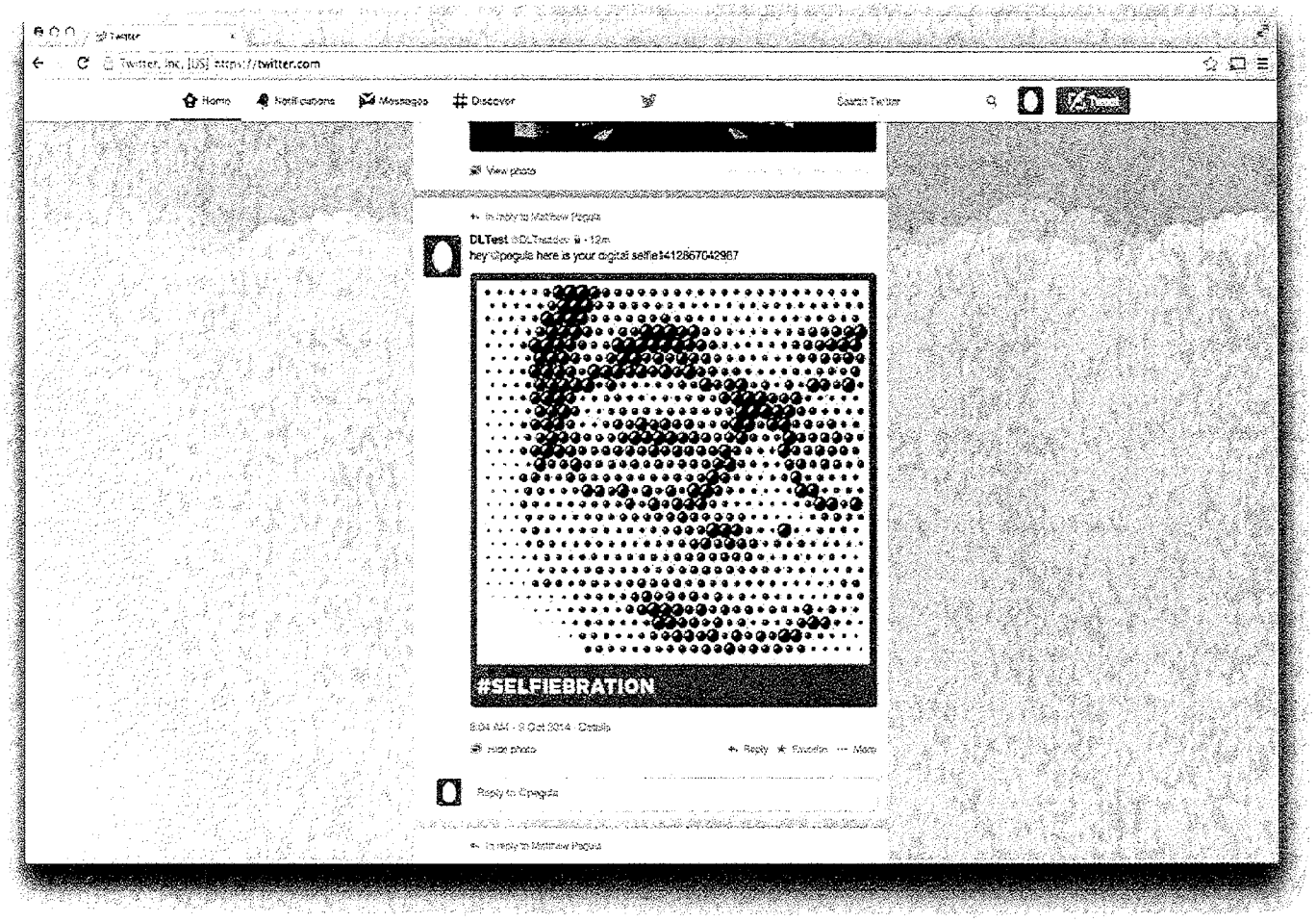
FIG. 5 is illustrative of a digital rendering of a balloon display utilizing the device and method of the present disclosure.

In one embodiment, the present disclosure provides for a method of generating a digital rendering of a balloon display representative of a digital image. This method may comprise most of the steps of a method creating an actual balloon display, but instead of sending the instructions to the device, they are processed using software. Such an embodiment may comprise converting a digital image and/or video into readable instructions for creating the digital rendering. The same algorithms may be applied to assess each pixel of the image and determine the desired virtual balloon diameter. These instructions may then be processed using software to create the digital rendering. Because the same algorithms are used in both the actual and the virtual displays, the digital rendering will appear substantially similar to how the image would appear if transmitted to the device to create an actual display. An example of a digital rendering is provided in FIG. 5. It can be seen from the figure that the various virtual balloons vary in diameter to create the display. These digital renderings may be transmitted to third party users (who may have generated the original digital image) and posted online, for example to social media platforms.

While the disclosure has been described in detail in reference to specific embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

What is claimed is:

1. A device comprising:

at least one processor configured for generating and transmitting multiple sets of instructions for creating a plurality of different balloon displays representative of different digital images by re-inflating a plurality of balloons; and a balloon display panel operably coupled to the processor wherein the balloon display panel further comprises a plurality of balloons, where each balloon is operably connected to at least one balloon box, and wherein each balloon box further comprises:

at least one pneumatic control operably coupled to each balloon, wherein the pneumatic control comprises at least one valve, and at least one electronic control, wherein each electronic control is configured to receive the sets of instructions from the processor and cause at least one pneumatic control to execute the instructions to thereby create the plurality of different balloon displays, wherein the instructions further comprise commands for turning on or off at least one specified valve which results in inflating, deflating, or maintaining the inflation of at least one corresponding balloon.

2. The device of claim 1 further comprising a means for delivering at least one compressed gas to each pneumatic control.

3. The device of claim 1 wherein the pneumatic control further comprises at least one orifice.

4. The device of claim 1 wherein the pneumatic control further comprises at least one manifold.

5. The device of claim 1 wherein the pneumatic control further comprises at least one air regulator.

6. The device of claim 1 wherein the pneumatic control further comprises at least one receiver.

7. The device of claim 1 wherein the pneumatic control further comprises at least one pressure gauge.

8. The device of claim 1 further comprising at least one air compressor.

9. The device of claim 1 wherein the electronic control further comprises at least one microprocessor.

10. A method comprising:

converting one or more digital images into one or more sets of readable instructions for creating a plurality of different balloon displays representative of the digital images by re-inflating a plurality of balloons, wherein each set of instructions further comprise at least one command for turning on or off at least one specified valve which results in inflating, deflating, or maintaining the inflation of at least one corresponding balloon and wherein converting the digital image further:

comprises converting the digital image into a specified number of pixels wherein each pixel corresponds to at least one balloon of the balloon display device, and assessing the intensity of each pixel to thereby determine the diameter of each balloon in the balloon display device required to create the balloon display;

transmitting the instructions to a balloon display device; and executing the instructions to create the plurality of different balloon displays.

11. The method of claim 10 wherein the commands further comprise timing components.

12. The method of claim 10 further comprising applying at least one pre-processing technique to the digital image.

13. The method of claim 10 wherein the instructions further comprise a plurality of instruction sets, each instruction set corresponding to at least one location of the balloon display.

14. The method of claim 10 wherein the digital image is generated by a third party user.

15. The method of claim 10 further comprising:

accessing the digital image, evaluating the digital image, and determining whether or not to create a balloon display representative of the digital image.

16. The method of claim 10 further comprising generating at least one of a digital image and a video of the balloon display.

17. The method of claim 16 further comprising:

converting at least one of the digital image and the video into at least one animated GIF, and transmitting the animated GIF to a third party user.

18. A system comprising:

a processor; and a non-transitory processor-readable storage medium in operable communication with the processor, wherein the storage medium contains one or more programming instructions that, when executed, cause the processor to perform the following:

convert one or more digital images into one or more sets of readable instructions for creating a plurality of different balloon displays representative of the digital images by re-inflating a plurality of balloons, wherein each set of instructions further comprise commands for turning on or off at least one specified valve which results in inflating, deflating, or maintaining the inflation of at least one corresponding balloon and wherein converting the digital image further:

comprises converting the digital image into a specified number of pixels wherein each pixel corresponds to at least one balloon of the balloon display device, and assessing the intensity of each pixel to thereby determine the diameter of each balloon in the balloon display device required to create the balloon display;

transmit the instructions to the balloon display device; and execute the instructions to create the balloon display.

* * * * *